United States Patent [19]

Weisz

[11] 3,949,690

[45] Apr. 13, 1976

[54] INTERPOSER HOOK DRIVE FOR SEWING MACHINES

[75] Inventor: William Weisz, Rockaway, N.J.

[73] Assignee: The Singer Company, New York, N.Y.

[22] Filed: Sept. 12, 1975

[21] Appl. No.: 612,816

[52] U.S. Cl. ..... 112/184; 112/191

[51] Int. Cl.[2] ..... D05B 57/14

[58] Field of Search ..... 112/184, 181, 182, 191, 112/189, 190, 192, 193

[56] References Cited

UNITED STATES PATENTS

| | | | |
|---|---|---|---|
| 2,148,385 | 2/1939 | Waterman | 112/184 |
| 3,362,364 | 1/1968 | Bono | 112/188 |
| 3,693,566 | 9/1972 | Ketterer | 112/184 |

FOREIGN PATENTS OR APPLICATIONS

| | | | |
|---|---|---|---|
| 100,036 | 9/1973 | Germany | 112/181 |
| 581,203 | 1/1963 | Japan | 112/181 |

*Primary Examiner*—H. Hampton Hunter
*Attorney, Agent, or Firm*—Robert E. Smith; Edward L. Bell; Julian Falk

[57] ABSTRACT

This disclosure relates to means for providing adjustment of the needle to hook point relationship in a sewing machine without disturbing the proper mesh and timing of the gears used in the drive mechanism for the hook. The hook includes a shaft supported in a bushing which has a bore having an axis eccentric to the axis of the bushing body. An interposer member is operatively connected to the drive mechanism and is disposed coaxially with the hook shaft for transmitting driving motion to the hook shaft. The hook point is adjustable relative to the needle by means of rotation of the hook bushing about its axis which thereby changes the relative position of the hook and its shaft without causing any change in the relative driving relationship of the interposer and the drive mechanism thereby unaffecting the timing of the hook drive mechanism.

7 Claims, 3 Drawing Figures

INTERPOSER HOOK DRIVE FOR SEWING MACHINES

BACKGROUND OF THE INVENTION

It is generally understood in sewing machines that the timing between the reciprocating needle and the rotating loop taker or hook is critical so that the loop seizing beak of the hook will be in the proper position for seizing a loop of thread from the needle for preventing skip stitches or the like. The loop seizing beak of the hook must pass closely adjacent to the needle to seize the loop of thread therefrom and must pass the needle in timed relation thereto and at a fixed distance beneath the work supporting surface of the machine. It has been necessary heretofore to provide separate means for making final adjustment of the hook point to needle relationship which means have been cumbersome and difficult to adjust. Further, in machines wherein the hook is driven by gearing between the machine drive or bed shaft and the hook shaft the meshing and timing of this gearing also becomes critical.

It has been proposed that to account for the critical relationship between the hook loop seizing beak and the needle means be provided for adjusting their relative positions. For example, such means are disclosed in U.S. Pat. No. 3,362,364, Japanese Utility Model Registration No. 581,203, Jan. 26, 1963, or East German Patent No. 100,036, Sept. 5, 1973. However, devices as disclosed in the aforementioned patents have not always proved satisfactory since in cases wherein there is a gear drive between the drive shaft and the hook shaft, when such adjustments are made the meshing and timing of these gears is often disturbed.

According to the present invention, means are provided for permitting adjustment between the hook beak and the needle without disturbing the meshing and timing of the drive gears between the drive shaft or bed shaft and the drive gear connected to the hook shaft.

The construction of the present invention provides for a first bevel gear fixed to the bed shaft of the sewing machine which meshes with a second bevel gear or driven bevel gear which is freely rotatable on the outside diameter of the bushing supporting the hook shaft. An interposer member is fastened to the hook shaft and is connected in driving relationship with the driven bevel gear by means of a driver member. The hook shaft is disposed in a bore in a hook shaft bushing which bore has its axis eccentric to or spaced from the true axis from which the outer peripheral surface of the bushing is generated. The interposer member is disposed co-axially with the axis of the hook shaft. In order to provide adjustment between the loop seizing beak of the hook, means may be provided for rotating the hook shaft bushing member which, as described above, has a bore whose axis is eccentric to the true axis of the bushing itself so that as the bushing is rotated the hook shaft will be radially displaced which in turn changes the position of the beak of the hook. Since the interposer member is co-axial with the hook shaft rotation of the hook shaft bushing about its axis will radially displace the interposer but because of the driving relationship between the interposer and the driven bevel gear, this displacement does not affect the relative position of the driven bevel gear and therefore will not affect its meshing engagement with the bevel gear on the bed shaft or the timing of the drive for the hook.

Accordingly, it is one object of the invention to provide a novel and improved drive mechanism for a rotary hook.

It is another object of the invention to provide a novel and improved means for adjusting the relative position of the loop seizing beak of the rotary hook relative to the needle which adjustment does not affect the meshing and timing of the gear drive for the rotary hook.

Other objects and advantages of the invention will be best understood upon reading the following detailed description with the accompanying drawings.

DETAILED DESCRIPTION OF THE PREFERRED EMBODIMENT

Figure 1:
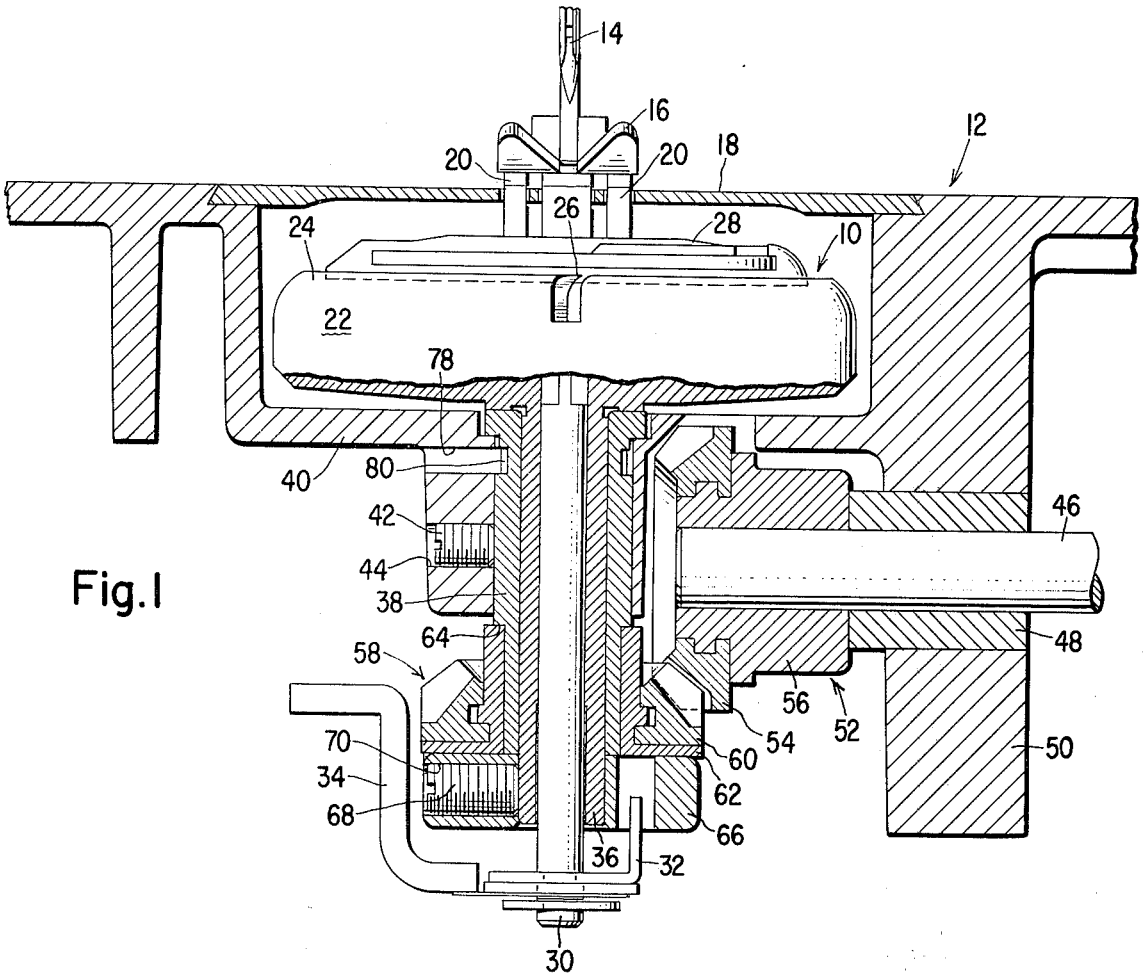
FIG. 1 is a vertical cross-sectional view taken parallel to the sewing machine bed and showing portions of the sewing mechanism in elevation.

The drawings illustrate only a fragment of a sewing machine in the vicinity of the hook, generally indicated at 10. The hook 10 is illustrated as supported in the sewing machine bed portion 12 in a manner which will be more fully described hereinafter. A fragment of a thread carrying needle 14 and a presser foot 16 are also illustrated in FIG. 1 which form conventional parts of a sewing machine, as is known in the art. Any conventional actuating mechanism may be employed for operating the needle in its reciprocating motion as well as for utilizing the presser foot in combination with the hook for the formation of lock stitches. Preferably, the needle is reciprocated in an endwise relationship and the hook is rotated in timed relation therewith two revolutions during each reciprocation of the needle. The actuating mechanism for the needle may take the form of that illustrated in U.S. Pat. No. 3,115,855 to which reference may be made as illustrative of an actuating mechanism for the sewing elements or mechanism of the sewing machine. A removable needle plate 18 is also provided for supporting the work between said needle plate and the presser foot and a feed dog mechanism 20 is also provided for feeding the work during the formation of stitches. Suitable apertures are provided in the needle plate 18 for permitting penetration of the needle 14 through the work and to a position for cooperation with the hook and also to permit reciprocation of the feed dog for feeding the work.

The hook 10 includes a cup-shaped body 22 including a rim 24 in which is formed a loop seizing beak 26 for seizing a loop of thread from a needle 14 during reciprocation of the needle and timed rotation of the hook. Disposed within the cavity formed by the cup-shaped body 22 of the hook is a bobbin 28 for storing a supply of thread which during the formation of lock stitches is concatenated with the needle thread in a known manner. A spindle 30, an up-turned finger 32 and laterally extending arm 34 cooperate with the bobbin to form a bobbin winder mechanism or replenishing mechanism of the type disclosed in U.S. Pat. No. 3,693,566. The bobbin winding mechanism itself forms no part of the present invention and reference may be made to the aforementioned patent for a more complete description thereof.

As further shown in FIG. 1, the hook 10 includes a shaft 36 depending from the cup-shaped body portion and which shaft 36 is supported in a bushing 38. The bushing 38 is supported in a web 40 of the bed portion of the sewing machine and is restrained from rotation by means of a set screw 42 disposed in a threaded bore 44 in the web 40. The removal of the set screw 42 or the loosening thereof will permit the bushing 38 to be rotated, the purpose of which will be apparent from the description hereinafter.

In order to drive the hook 10, a bed shaft 46 is supported by a bushing 48 in a web 50 of the sewing machine bed portion 12. The bed shaft 46 is suitably driven by an electric motor or other suitable means well-known in sewing machines. A bevel gear 52 which preferably is a composite gear, is fixed to the end of the bed shaft 46 adjacent to the hook in driving relationship therewith and is formed with a toothed portion 54 and a core portion 56. A second bevel gear 58 having its axis perpendicular to the bevel gear 52 is also preferably a composite gear and is formed with a toothed portion 60 and a core portion 62. The bevel gear 58 is supported such that it is freely rotatable with respect to the bushing 38 and the hook shaft 36 but is constrained from motion parallel to the axis of the shaft 36 by a shoulder 64 formed on the bushing 38 which cooperates with the axially extending portion of the core 62 of the composite gear 58.

Figure 2:
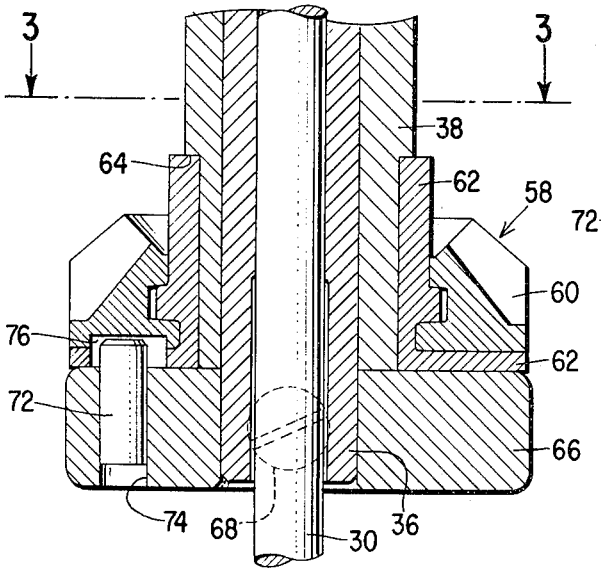
FIG. 2 is an enlarged vertical cross-sectional view of a portion of the hook drive mechanism illustrated in FIG. 1.

An interposer member 66 which is in the form of an annular member, is collar fastened to the shaft 36 of the hook 10 by means of a set screw 68 threaded into a bore 70 of the interposer member 66. As seen in FIG. 2 a pin or driver member 72 is fixed within a bore 74 in the interposer member 66 and extends slightly above the upper surface of the interposer member 66. A slot 76 is provided in the gear 58 and receives the driver 72 therein so that rotation of the gear 58 will be transmitted through the slot 76 and pin or driver 72 to the interposer 76 and ultimately to the shaft 36 of the hook 10. The slot 76 is formed such that rotary movement between the gear 58 and the interposer 66 will be transmitted substantially play-free but the radial extension of the slot 76 which is larger than the diameter of the driver 72 will permit relative radial movement between the gear 58 and the interposer 66.

Figure 3:
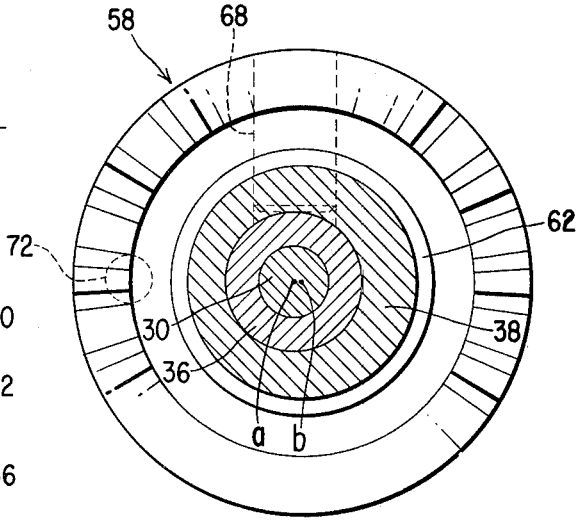
FIG. 3 is a cross-sectional view taken substantially along line 3—3 of FIG. 2.

Referring to FIG. 3, as shown therein the spindle 30 and the shaft 36 of the rotary loop taker 10 are disposed within the bushing 38. It will be further seen that the bore in the bushing has an axis *a* which is eccentric relative to the axis *b* of the bushing body. In other words, the axis of the bore in the bushing is offset with respect to the axis from which the outer peripheral surface of the bushing is circumscribed. The axis of the bushing from which the outer peripheral surface is circumscribed will be hereinafter referred to as the true axis. With further reference to the drawing, the gear 58 is supported coaxially with the true axis of the bushing 38 and with the axis of the bore in the web 40 which contains the bushing 38.

The disposition of he elements described thus far will be seen as providing for a relationship which permits adjustment of the hook beak 26 to the needle point without disturbing the timing and meshing between the gear 54 and the gear 58. When it is desired to adjust the relationship between the hook point or beak to the needle, the set screw 44 may be loosened and the bushing 38 is caused to rotate about the true axis within the bore in the web 40 in which it is supported. Rotation of the bushing 38 may be, for example, initiated by a tool inserted in a bore 78 in the web 40 for engaging teeth 80 formed on the body of the bushing 38. When the bushing 38 is rotated about the true axis, it will be apparent that the eccentric bore will be caused to rotate about said true axis. As the eccentric bore is rotated about the true axis, since the shaft 36 of the hook is contained within said bore it will move in an eccentric motion relative to the true axis of the bushing. This movement will cause a radial displacement of the shaft 36 and consequently the beak or hook point 26 relative to the needle 14. It should be understood that such adjustments are generally very minor and that the rotation of the bushing 38 is only required to be a few degrees in either direction in most instances. As discussed above, adjustment or rotation of the bushing 38 will result in a radial displacement of the shaft 36 which will then be transmitted to the interposer 66 since these two members are fastened together. The radial displacement of the interposer members 66 will be taken up by the relationship of the driver 72 in the slot 76 in gear 58 without affecting the driving relationship betweeen the gear 58 and interposer 66. Thus any radial displacement of the interposer 66 substantially unaffects the radial position of the gear 58, which is co-axial with the bushing 38 and shaft 36, and has no affect on the relationship between the timing and meshing of the gears 58 and 54. Therefore, as described above a novel means is provided for adjusting the relationship between the hook point and the needle without affecting the relationship between the drive gears and the gear driven hook. It will be apparent that the construction of the present invention provides a mechanism wherein the aforementioned adjustment can be carried out relatively quickly and without any concern that the timing of the driving mechanism will be altered. This has a distinct advantage over prior known mechanisms wherein after each adjustment of the hook point to needle relationship the timing and meshing of the gears had to be checked to re-establish the proper relationship therebetween so as not to affect the relationship between the hook and the needle which could result in poor quality of stitching or complete absence thereof.

While the invention has been described above in its preferred embodiment, it will be obvious to those skilled in the art that various changes and modifications can be made therein without departing from the spirit and scope of the invention as set forth in the appended claims.

Having thus described the nature of the invention, what we claim herein is:

1. A hook mechanism for a sewing machine having a rotary driven hook including a shaft for supporting said hook for rotation about the axis of said shaft, a bushing for supporting said shaft in a frame, a bore through said bushing with the axis of said bore being eccentric to the axis of said bushing, said shaft being supported in said bore for rotation relative to said bushing, drive means for driving said hook including a first drive member operably connected to a drive shaft for driving said first drive member, an interposer member drivingly connected to said first drive member in timed relationship therewith and operably connected to said shaft for transmitting driving motion to said shaft, said interposer member being supported co-axially with axis of said hook, and means for adjusting the relative radial position of said shaft without changing the relative driving relationship between said interposer member and said first drive member such that adjustment of the relative radial position of said shaft has no effect on the timing between said drive means and said hook.

2. A hook mechanism as recited in claim 1 wherein said interposer is fastened to said shaft.

3. A hook mechanism as recited in claim 1 wherein said first drive member comprises of first gear drivingly connected to said interposer member and said first gear being supported coaxially with said bushing.

4. A hook mechanism as recited in claim 3 wherein said drive means includes a second gear disposed in meshing engagement with said first gear and said second gear being connected to a drive shaft for driving said first gear and said interposr member.

5. A hook mechanism as recited in claim 3 wherein said first gear is drivingly connected to said interposer member by means of a driver member fixed to said interposer member and disposed in a slot in said first gear for permitting relative radial movement between said interposer member and said first gear.

6. A hook mechanism as recited in claim 1 wherein said means for adjusting the relative radial position of said shaft comprises means for rotating said bushing about its axis whereby rotation of said bushing and its bore about the axis of said bushing will cause said shaft to shift radially relative to the bushing axis without initiating radial shifting of said first drive member.

7. A hook mechanism as recited in claim 6 wherein said interposer member is disposed for radial movement relative to said first drive member.

* * * * *